US008726575B1

(12) United States Patent
Vulpitta et al.

(10) Patent No.: US 8,726,575 B1
(45) Date of Patent: May 20, 2014

(54) DOOR OR WINDOW SEAL

(71) Applicants: Brian A. Vulpitta, Avon Lake, OH (US); Daniel Festa, Strongsville, OH (US); Scott Sommers, Avon Lake, OH (US); Vageesh Bakhshi, Brecksville, OH (US)

(72) Inventors: Brian A. Vulpitta, Avon Lake, OH (US); Daniel Festa, Strongsville, OH (US); Scott Sommers, Avon Lake, OH (US); Vageesh Bakhshi, Brecksville, OH (US)

(73) Assignee: Shurtech Brands, LLC, Avon, OH (US)

( * ) Notice: Subject to any disclaimer, the term of this patent is extended or adjusted under 35 U.S.C. 154(b) by 0 days.

(21) Appl. No.: 13/798,324

(22) Filed: Mar. 13, 2013

(51) Int. Cl.
*E06B 7/22* (2006.01)

(52) U.S. Cl.
USPC ..... 49/470; 49/490.1

(58) Field of Classification Search
USPC ..... 49/467, 469, 470, 480.1, 490.1, 495.1, 49/498.1
See application file for complete search history.

(56) References Cited

U.S. PATENT DOCUMENTS

| | | | | | |
|---|---|---|---|---|---|
| 712,240 | A | * | 10/1902 | Barnes | 49/499.1 |
| 1,336,527 | A | | 4/1920 | Lewis | |
| 1,452,703 | A | * | 4/1923 | Pollard | 49/482.1 |
| 1,625,764 | A | | 4/1927 | Bosley | |
| 1,883,609 | A | | 10/1932 | Dennis | |
| 2,347,158 | A | | 4/1944 | Spraragen | |
| 2,560,308 | A | | 7/1951 | Spraragen | |
| 2,949,651 | A | * | 8/1960 | Hill | 49/493.1 |
| 3,273,287 | A | * | 9/1966 | Pease, Jr. | 49/468 |
| 3,360,887 | A | * | 1/1968 | Parks et al. | 49/490.1 |
| 3,378,958 | A | * | 4/1968 | Parks et al. | 49/489.1 |
| 3,448,543 | A | * | 6/1969 | Multer | 49/470 |
| 3,854,246 | A | * | 12/1974 | McAllister | 49/470 |
| 4,006,562 | A | * | 2/1977 | Belanger et al. | 49/380 |
| 4,034,511 | A | | 7/1977 | Bursk | |
| 4,114,319 | A | * | 9/1978 | Governale | 49/489.1 |
| 4,119,325 | A | * | 10/1978 | Oakley et al. | 277/642 |
| 4,483,101 | A | | 11/1984 | Berzina | |
| 4,639,027 | A | | 1/1987 | Boyd | |
| 4,691,478 | A | | 9/1987 | Lorg | |
| 4,712,331 | A | * | 12/1987 | Fujiwara | 49/489.1 |
| 4,765,094 | A | | 8/1988 | Gemmell | |
| 5,056,263 | A | * | 10/1991 | Bies | 49/484.1 |
| 5,174,065 | A | * | 12/1992 | Schlicht | 49/489.1 |
| 5,214,880 | A | * | 6/1993 | Woodruff et al. | 49/490.1 |
| 5,475,946 | A | | 12/1995 | Howe | |
| 5,475,948 | A | | 12/1995 | Parke | |
| D371,600 | S | | 7/1996 | Henry | |
| 5,581,951 | A | * | 12/1996 | Ryan et al. | 49/498.1 |
| 5,794,871 | A | | 8/1998 | Willetts | |
| 6,052,949 | A | * | 4/2000 | Procton et al. | 49/506 |

(Continued)

FOREIGN PATENT DOCUMENTS

| | | |
|---|---|---|
| FR | 2 675 532 A1 | 10/1992 |
| FR | 2 787 825 A3 | 6/2000 |

(Continued)

*Primary Examiner* — Katherine Mitchell
*Assistant Examiner* — Justin Rephann
(74) *Attorney, Agent, or Firm* — Fay Sharpe, LLP

(57) ABSTRACT

A one-piece seal for use on the bottoms of doors or windows of uniform cross-section has a planar base and upwardly extending members on each side of the base with engagement members at the top of the upwardly extending members. The seal also has downwardly extending fins and semicircular walls to engage a threshold. The seal is held upon a door by action of the flexible engagement members being pressed against the sides of the doors by the upstanding members.

11 Claims, 3 Drawing Sheets

(56) References Cited

U.S. PATENT DOCUMENTS

| | | | | |
|---|---|---|---|---|
| 6,374,545 | B1 * | 4/2002 | Baczuk | 49/470 |
| 6,478,308 | B1 * | 11/2002 | McMillin et al. | 277/630 |
| 6,560,932 | B2 | 5/2003 | Heroux | |
| 7,401,439 | B2 | 7/2008 | Heroux | |
| 7,891,136 | B1 | 2/2011 | Heroux | |
| 8,051,605 | B2 * | 11/2011 | Rissone | 49/467 |
| 8,418,426 | B2 * | 4/2013 | Rissone | 52/717.01 |
| 2007/0261312 | A1 * | 11/2007 | Kuppler | 49/470 |
| 2011/0120023 | A1 | 5/2011 | Heroux | |
| 2012/0079771 | A1 * | 4/2012 | Meulemans | 49/484.1 |

FOREIGN PATENT DOCUMENTS

| | | | |
|---|---|---|---|
| GB | 875480 | | 8/1961 |
| GB | 1079667 | | 8/1967 |
| GB | 2109447 | | 6/1983 |
| GB | 2 170 541 | A | 8/1986 |
| GB | 2 238 069 | A | 5/1991 |
| GB | 2255121 | | 10/1992 |
| GB | 2 294 282 | A | 4/1996 |

* cited by examiner

DOOR OR WINDOW SEAL

BACKGROUND

This disclosure relates to seals for preventing drafts and the like at door bottoms, window bottoms and other similar places for a moving structural element can be opened and closed within an aperture. More particularly, this disclosure relates to an extruded one-piece seal adapted for easy application to a door bottom or window bottom to prevent drafts and water intrusion at the door bottom or window bottom.

Entry doors in residences, businesses and other structures often consist of a rectangular door which is hinged upon one side and open more by swinging laterally upon the hinge. Doors frequently are mounted in door frames consisting of two parallel upright sides and a top interconnecting the tops of the sides. A threshold is sometimes placed at the bottom of the door frame. Many doors are sold pre-assembled to a door frame for installation in a wall as a unit. For interior doors this completes the structure. For exterior doors, a threshold is often added and a sealing mechanism is sometimes added between the door bottom and the threshold. Particularly, for doors opening to the open "outdoors" are sometimes the source of drafts, water intrusion or insect intrusion. To remedy these situations, numerous attempts to provide reliable, economical seals at the interface between the bottom of the door and the threshold have been made. However, proper sealing can be difficult for a number of reasons.

Many homes and businesses have carpeting. A door is sometimes trimmed along its bottom so the door can swing over the carpeting. This sometimes takes the bottom of the door out of proper engagement with the threshold or other device forming the bottom of the doorway.

People walk through doorways and step on thresholds. Thresholds are often worn or deformed by constant foot traffic. People also often carry or roll heavy loads through doorways which can damage, wear or destroy a threshold. Thus, the interface between the bottom of the door and the threshold often include an opening of varying height. The threshold surface and the door surface is also of varying quality across the length and thickness of the door bottom and the length and width of the threshold.

Many homes are rental units. Some renters are prohibited from using fasteners on doors and walls other home owners and home occupants are not particularly handy with tools.

SUMMARY OF THE DISCLOSURE

The present disclosure contemplates a new and improved seal of the type to be applied to the bottom of the door, window or similar structure which addresses the above-described problems and others and provides a one-piece extruded seal which can be applied by the consumer without the use of fasteners.

In accordance with the invention, a seal has a substantially uniform cross section and comprises a planar base and two upstanding sides extending from the edges of the base, resilient engagement members extend from the top edges of the upwardly extending members; and, fins and half rounds extend downwardly from the base, all these elements forming part of one unitary structure.

Yet further in accordance with the invention, the upwardly extending members extend upwardly and slightly inwardly so that the top edges of the upwardly extending members are closer to one another than the bottom portions of the upwardly extending members.

Still further in accordance with the disclosure, the engagement members extend inwardly and downwardly adjacent the upwardly extending members and are more resilient than the upwardly extending members.

Still further in accordance with the disclosure, the fins and half rounds extending from the bottom of the base member are more resilient than the base member.

Yet further in accordance with the invention, the base member and the upwardly extending bar are resilient.

Yet further in accordance with the disclosure, the entire seal is an extruded shape.

Yet further in accordance with the disclosure, the entire seal is an extruded shape made as a co-extrusion using materials having different characteristics for some of the different members of the structure.

The principal object of the disclosure is to provide a sealing structure adapted to prevent drafts and otherwise seal the interface between the bottom of a door and a threshold, the bottom of a window and a window sill, or other similar structures.

It is yet another object of the disclosure to provide a seal of one-piece construction which can be cut to length by a consumer and applied to a door bottom or window bottom without the use of adhesive, fasteners or tools.

It is yet another object of the present disclosure to provide a seal which is inexpensive to manufacture, easy to understand, easy to use and which provides a good seal between a door bottom and threshold or other similar paired structures.

Further objects and advantages of the disclosure will be apparent from the following detailed description of an embodiment thereof and from the accompanying drawings.

DETAILED DESCRIPTION

Figure 2:
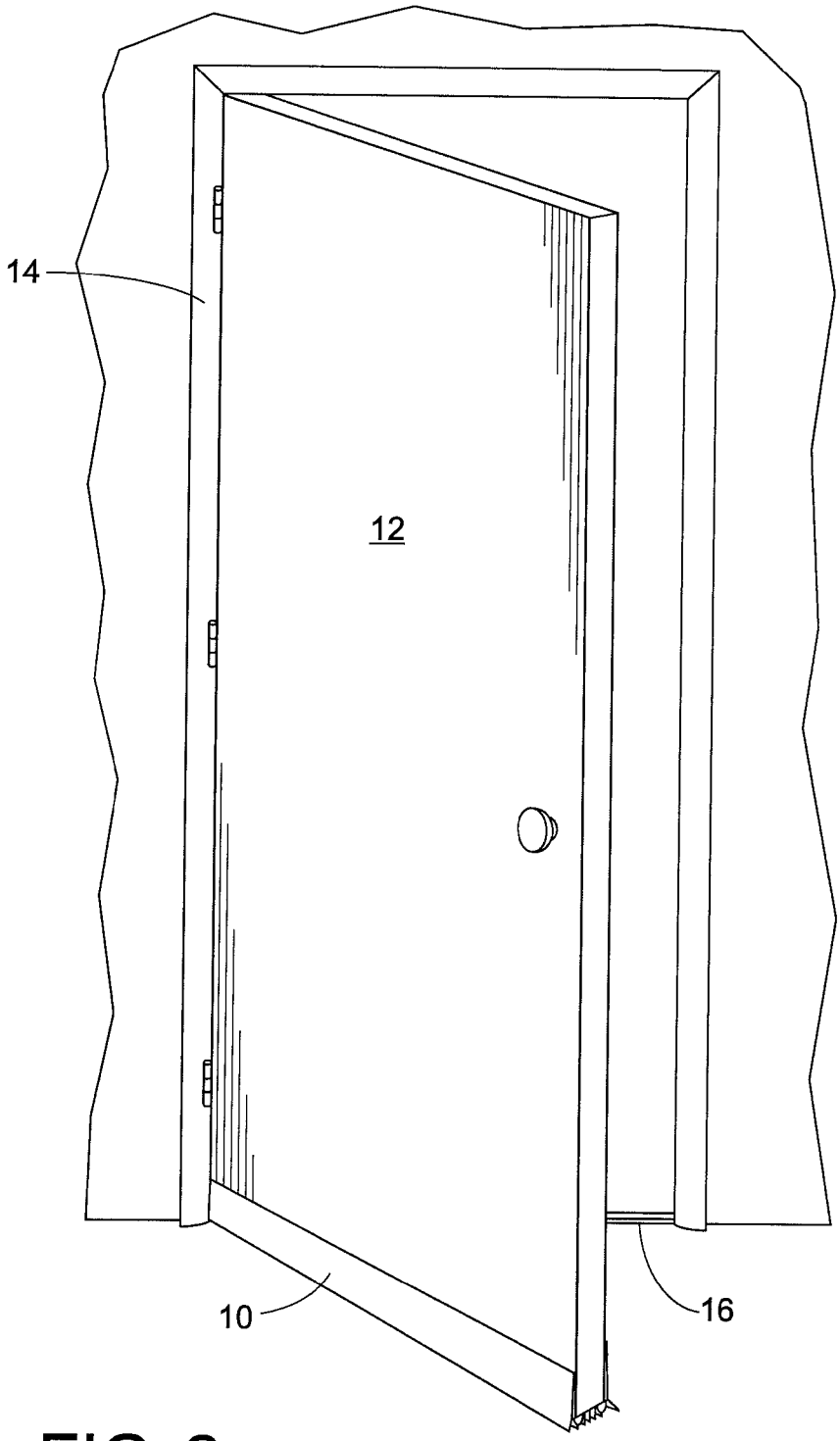
FIG. 2 is a schematic perspective of a door in a door frame with the seal seen in FIG. 1 applied to the bottom of the door; and, FIG. 3 is a detailed schematic end view of the seal on the bottom of the door seen in FIG. 2 with the door closed over the threshold.

Referring now to the drawings wherein the showings are for the purposes of illustrating an embodiment of the disclosure and not for the purposes of limiting same, the figures show a seal 10 applied on the bottom of a door 12 (FIG. 2). The door 12 is supported on one side by hinges attached to a door frame 14. The door frame is in the shape of an inverted U with the open end of the U at the floor. A threshold 16 extends across the bottom of the door frame 14.

Figure 1:
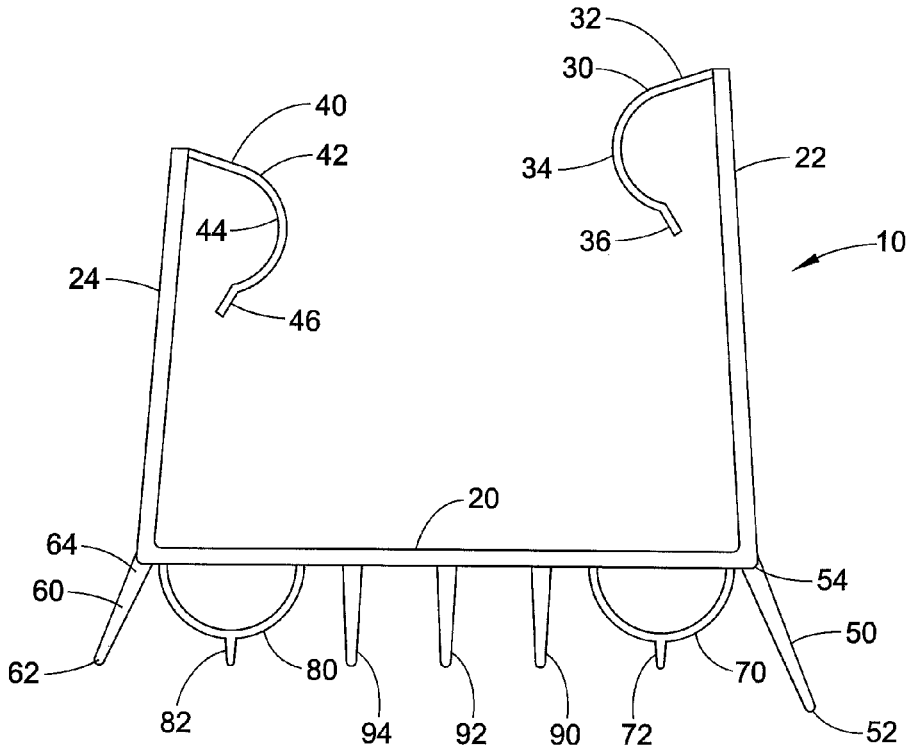
FIG. 1 is an end view of a seal in accordance with the present disclosure.

The seal 10 is shown in more detail in FIG. 1. The seal 10 is an extrusion of polymeric material. More particularly, the seal 10 is a co-extrusion in which certain portions of the finished extrusion are more resilient than other portions. Thus, certain portions may have a different hardness than other portions.

The seal 10 has a uniform cross section with the following elements heading a substantially uniform and continuous shape over the entire length of the extrusion. Minor variations and surface flaws may result.

The seal 10 has a planar base 20, a first upwardly extending member 22 and a second upwardly extending member 24. The upwardly extending members extend upwardly from the edges of the planar base 20. The upwardly extending members 22, 24 extend upwardly and slightly toward one another from the two edges of the planar member 20. Thus, the planar base 20 and the two upwardly extending members 22, 24 form a U shape in which the bottom of the U is planar and the legs of the U extend upwardly and inwardly toward one another. The angle between the upwardly extending members 22, 24 and the planar member is about 85°. Thus, if the planar member is considered horizontal, the upwardly extending members deviate from vertical by about 5°. These angles are "extruded". The planar base 20 and the upwardly extending members 22, 24 are extruded from a polymeric material having resilience. Thus, one can hold the tops of the upwardly extending members 22, 24 away from each other or push them towards one another with simple finger pressure.

The planar base 20 and the upwardly extending members 22, 24 are slightly less than 1/16 inch thick (less than 1.5 millimeters). This thickness is uniform and not critical.

The first upwardly extending member 22 extends about 1.5 inches (3.8 centimeters) above the planar base 20. The second upwardly extending member 24 extends about 1.25 inches (3.1 centimeters) above the planar member 20.

Upwardly is used herein to describe relative orientation and location of elements as seen in the figures and as one would mount the seal 10 upon the bottom of the door. However, upwardly is a relative term and a seal 10 applied vertically along a door or in a different orientation but having the same general configuration is also contemplated in this disclosure. "Inwardly" is used to describe an orientation or the direction in which something extends toward the center line of the planar base 20. "Member" is used to identify portions of the seal 10 which are differentiable from other portions and serve different functions but are part of the same unitary extrusion or part.

As can be seen in FIG. 1, the U-shaped seal 10 defines an interior bottom with the bottom of the U further apart than the top of the U. In the illustrated embodiment, the bottom interior sides of the first and second upwardly extending members are about 1.79 inches apart. The top interior sides of the first and second upwardly extending members 22, 24 may be offset from one another vertically but are about 1.6 inches apart. A first engagement member 30 extends inwardly and downwardly from the top of the first upwardly extending member 22. The first engagement member 30 has a first planar portion 32 extending downwardly and inwardly from the top of the first upwardly extending member 22; and an arcuate portion 34 extending from the edge of the first planar portion 32 remote from the first upwardly extending member 22; and, a second planar portion 36 extending from the end of the arcuate portion 34 remote from the first planar portion 32. The arcuate portion 34 is a portion of the circle which is not quite a half circle. The entire length of the first engagement member 30 (if flattened out) is about half the height of the first upwardly extending member 22. The first engagement member 30 has uniform thickness about half the thickness of the first upwardly extending member 22. The first engagement member 30 is extruded from a polymer having more resiliency, that is softer, than the polymer from which the planar base 20 and the first and second upwardly extending members 22, 24 are extruded.

A second engagement member 40 extends inwardly and downwardly from the top of the second outwardly extending member 24. The second engagement member 40 has a first planar portion 42, an arcuate portion 44, and a second planar portion 46. The second engagement member 40 is the mirror image of the first engagement member 30 and is fabricated from the same softer material.

A first corner fin 50 extends downwardly and outwardly from the edge of the planar base 20 adjacent the first upwardly extending member 22. The first corner fin 50 is about 3/8 inches in length and tapers to be less thick at its remote end 52 when compared to its base 54 adjacent the planar base 20. A similar second corner fin 60 extends from the edge of the planar base 20 adjacent the second upwardly extending member 24. The second corner fin 60 tapers from a thicker thin base 64 to a thinner remote end 62.

A first semicircular tube 70 extends downwardly from the planar base 20 adjacent the first corner fin 50. The first semicircular tube 70 has an "as extruded" radius somewhat greater than 1/8 of an inch. A rib 72 extends downwardly from the lowermost portion of the first semicircular tube 70. A second semicircular tube 80 and rib 82 extends downwardly from the planar base 20 inwardly from the second corner fin 60. Other than placement, the second semicircular tube 80 and rib 82 are completely identical to the first semicircular tube 70 and rib 72.

Three central fins 90, 92, 94 are spaced from one another and extend downwardly from the central portion of the planar base 20. The corner fins 50, 60, the semicircular tubes 70, 80 and the central fins 90, 92, 94 are all extruded from a polymeric material which is softer than the material used for the base 20 and the upwardly extending members 22, 24. This material can be the same material used for the engagement members or material having different characteristics.

Figure 3:
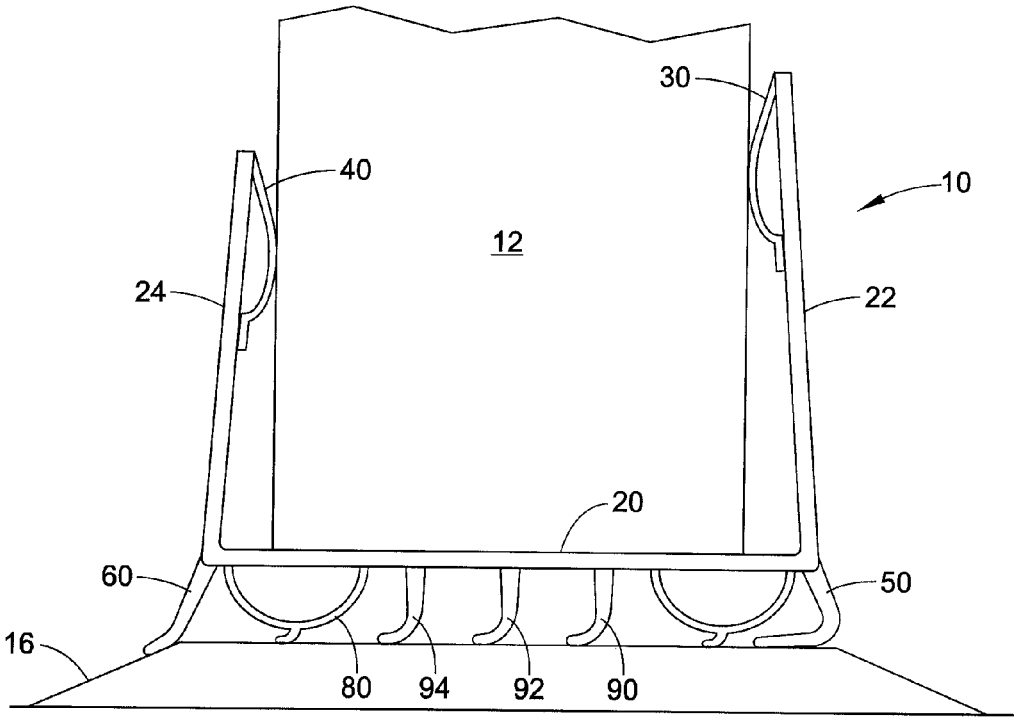

FIG. 3 shows the seal 10 mounted on a door 12 at the bottom of the door. The first upwardly extending member 22 lies close along the bottom of one side of the door; the second upwardly extending member 24 lies close along the bottom of the other side of the door and the planar base 20 lies close along the bottom of the door. The engagement members 30, 40 are deformed and pushed into very tight engagement against the sides of the door 12. A significant surface area of each engagement member 30, 40 is in contact with the surface of the door 12 and holds the seal 10 in place on the door 12. The two upwardly extending members 22, 24 can flex and change their relative orientation with respect to the base 20. This allows the seal to be applied to doors having various widths. The illustrated embodiment can accommodate a door from about 1.5 inches thickness to about 1.75 inches thickness and still maintain an attractive and tight fit on the bottom of the door. Of course, other sizes can be accommodated by simply changing the dimensions of the planar base 20 or other elements.

The flexibility (softness) of the engagement members 30, 40 allows the engagement members to closely engage the surfaces of the door and/or window frame and provides a substantially water tight seal. Moisture is not allowed to enter into the U-shaped interior of the seal 10. Door rot is avoided. Weep holes (not shown) may be provided where desirable.

Assembly of the seal 10 to the bottom of a door requires no tools. An appropriate seal 10 is purchased. If the seal is the appropriate length for the width of the door, it is applied to the door without further alteration. If the seal 10 is too long for the width of the door, it is first cut to length. Thereafter, the door is opened and the seal can be applied by manually pulling the upwardly extending members 22, 24 away from each other at one end and sliding the appliance onto the bottom of the door toward the hinge. The seal 10 is then urged upwardly into full engagement with the bottom of the door and is ready for use.

The action of the corner fins 50, 60, semicircular tubes 70, 80 and central fins 90, 92, 94 are also seen in FIG. 3. Doors often close from one direction in a swinging motion. Thus, the fins under the door which engage the threshold will "sweep" as the door is closed to its final position. This results in a substantially uniform curved orientation for the fins as seen in FIG. 3. The bottoms of the fins are engaged with the threshold. The semicircular tubes 70, 80 deform in a compressive manner rather than a sweep and the ribs 72, 82 for a slight sweep at the bottom of the semicircular tubes. This combination of semicircular compression with the rib at the bottom acts in a slightly different manner in sealing against the threshold and promotes a good seal across the entire length of the threshold that is the entire width of the door.

When the door 12 is opened, the fins and tubes deform into sweeping in the opposite direction and disengage from the threshold. The materials chosen for the seal 10 and particularly for the fins and tubes are selected to provide good durability and repeated deformability as the door may be opened and closed many times over the lifetime of the seal. As there are multiple sealing elements, should one rib break or not fully engage a low spot in the threshold, the remaining elements may provide a seal at that point.

The seal 10 is shown in FIGS. 1, 2 and 3 in use at the bottom of a door. The seal 10 can be used on a window of the sash variety or of the vertically opening variety (casement) and provide a good seal in that environment. Other applications of the seal 10 to other interfaces will occur to those with need.

The disclosed has been described with reference to an illustrated embodiment. It will be appreciated that modifications or alterations could be made without deviating from the present disclosure. Such modifications and alterations will occur to others upon the reading and understanding of the specification. It is intended that all such modifications and alterations be included insofar as they come within the scope of the appended claims or the equivalents thereof.

The invention claimed is:

1. A one piece seal adapted for use at the rectilinear periphery of a door or window, the seal having a substantially uniform cross section, the seal comprising:

a planar base member having a width, a thickness, an upper surface, a lower surface, a first edge and a second edge;

a first planar upwardly extending member extending upwardly from the base member first edge at a slightly acute angle, the first planar upwardly extending member having a top edge;

a second planar upwardly extending member extending upwardly from the base member second edge at a slightly acute angle, the second planar upwardly extending member having a top edge;

a first engagement member extending inwardly and downwardly from the top edge of the first planar upwardly extending member toward the second planar upwardly extending member;

a second engagement member extending inwardly and downwardly from the top edge of the second planar upwardly extending member toward the first planar upwardly extending member;

at least one fin extending downwardly from the base member lower surface;

at least a first generally arcuate wall extending downwardly from the base member, the first arcuate wall connected to the base member at a first end and a second end;

the entire one piece seal being resilient; and, wherein the base member and the first planar upwardly extending member and the second planar upwardly extending member have a first hardness and the first engagement member and the second engagement member have a second hardness softer than the first hardness.

2. The seal of claim 1 additionally comprising a fin extending downwardly and outwardly from the base first edge and a fin extending downwardly and outwardly from the base second edge.

3. The seal of claim 1 wherein the first arcuate wall has a lower surface and a fin extending downwardly from its lower surface.

4. The seal of claim 3 having at least a second arcuate wall extending downwardly from the base member, the second arcuate wall connected to the base member at both ends and having a lower surface and a fin extending downwardly from its lower surface.

5. The seal of claim 1 wherein the first engagement member has a curved portion extending downwardly toward the base member and the second engagement member has a curved portion extending downwardly toward the base member.

6. The seal of claim 1 wherein the first engagement member and the second engagement member are more flexible than the base member and the first planar upwardly extending member and the second planar upwardly extending member.

7. The seal of claim 4 wherein the fins and the walls are more flexible than the base member and the first planar upwardly extending member and the second planar upwardly extending member.

8. The seal of claim 7 wherein the base member and the first planar upwardly extending member and the second planar upwardly extending member have a first hardness and the fins and the walls have a second hardness softer than the first hardness.

9. The seal of claim 1 wherein the seal is an extruded polymer body.

10. The seal of claim 9 wherein the seal is a coextruded polymer body having portions with different properties of hardnesses or elasticity.

11. The seal of claim 1 wherein the seal is adapted to be held on an associated door or window by the engagement members and using no fasteners.

* * * * *